US006247256B1

(12) United States Patent
Simson et al.

(10) Patent No.: US 6,247,256 B1
(45) Date of Patent: Jun. 19, 2001

(54) SCROLLING SIGN RETROFIT KIT

(76) Inventors: Todd A. Simson; Anton K. Simson, both of 14530 Espola Rd., Poway, CA (US) 92064

( * ) Notice: Subject to any disclaimer, the term of this patent is extended or adjusted under 35 U.S.C. 154(b) by 0 days.

(21) Appl. No.: 09/251,211

(22) Filed: Feb. 16, 1999

Related U.S. Application Data

(63) Continuation-in-part of application No. 08/863,166, filed on May 27, 1997, now Pat. No. 5,953,840, which is a continuation-in-part of application No. 08/605,978, filed on Feb. 23, 1996, now Pat. No. 5,930,295, which is a continuation-in-part of application No. 08/195,394, filed on Feb. 14, 1994, now Pat. No. 5,493,802, which is a continuation-in-part of application No. 08/067,738, filed on May 26, 1993, now Pat. No. 5,410,330.

(51) Int. Cl.[7] ..... G09F 11/18
(52) U.S. Cl. ..... 40/471; 40/518
(58) Field of Search ..... 40/471, 518, 522

(56) References Cited

U.S. PATENT DOCUMENTS

| | | | | |
|---|---|---|---|---|
| 1,024,044 | * | 4/1912 | Tucker | 40/471 |
| 3,426,461 | * | 2/1969 | Miller | 40/471 |
| 3,726,031 | * | 4/1973 | Singer | 40/471 |
| 3,780,458 | * | 12/1973 | Jacoby et al. | 40/471 |
| 3,829,997 | * | 8/1974 | Singer | 40/518 |
| 5,392,549 | * | 2/1995 | Castro | 40/518 |
| 5,517,778 | * | 5/1996 | Simson | 40/471 |
| 5,809,677 | * | 9/1998 | Wamser et al. | 40/471 |
| 5,953,840 | * | 9/1999 | Simson et al. | 40/471 |

* cited by examiner

*Primary Examiner*—Joanne Silbermann
(74) *Attorney, Agent, or Firm*—Henri J. A. Charmasson; John D. Buchaca

(57) ABSTRACT

A set of simple and economical components is used to transform an existing back lighted sign into a self-propelled scrolling banner display. Only two structural parts are used, and the electro-mechanical components are limited to a step-down transformer, a rectifier circuit, a pair of motors, and a switch and voltage step-down diode assembly.

17 Claims, 1 Drawing Sheet

SCROLLING SIGN RETROFIT KIT

PRIOR APPLICATION

This is a continuation-in-part application of application Ser. No. 08/863,166 filed May 27, 1997 now U.S. Pat. No. 5,953,840, a continuation-in-part application of Ser. No. 08/605,978 filed Feb. 23, 1996, now U.S. Pat. No. 5,930, 295, a continuation-in-part of Ser. No. 08/195,394 filed Feb. 14, 1994, now U.S. Pat. No. 5,493,802 a continuation-in-part of Ser. No. 08/067,738 filed May 26, 1993, now U.S. Pat. No. 5,410,330.

FIELD OF THE INVENTION

This invention relates to back lighted signs and display devices and more particularly a to-back lighted scrolling banner signs and displays.

BACKGROUND OF THE INVENTION

Back lighted signs and displays are commonly used both indoors and outdoors in connection with many commercial operations. Typically, such a sign or display comprises an enclosure having an opaque back panel mounting one or more light fixtures, and a front panel having a cutout window mounting a transparent or semi-transparent panel carrying a message display. In some cases, the message or display is applied to a translucid banner mounted behind the transparent panel. It is sometimes desirable to change the message or display which necessitates the replacement of the front panel or of the translucid banner. Examples of this type of display can be found in most fast food establishments where menus are presented by large back lighted displays mounted above the ordering counter. As available breakfast, lunch time, and evening menus may differ, those displays must be impractically very large to accommodate all menus, or their display banners must be replaced three times a day.

Prior attempts at resolving the aforesaid problems by means of hand-powered banner moving mechanisms have resulted in complex structures that are prone to jamming.

The invention results from attempts to develop a practical and inexpensive means and manners to retrofit display devices of the prior art into a self-powered and quickly updatable display system.

SUMMARY OF THE INVENTION

The principal and secondary objects of this invention are to provide a simple, rapid, and economical method for implementing a self-powered scrolling display within an existing sign enclosure with or without back-lighting, and a minimum number of components to achieve this implementation. The aforesaid objects are achieved within all applicable governmental and insurance underwriter norms and specifications with minimal use of a low skill labor force. The preferred embodiment of the kit of components necessary to implement the scrolling display is limited to two rail assemblies, an electrical assembly, a pair of rollers and a banner scroll. A pair of motor drive units are mounted on the upper and lower end of one of the rails. A pair of spring-biased pintles are mounted at corresponding opposite locations on the other rail. A double-pole, three-position switch is used to apply a rectified voltage to the motor drive units across a pair of oppositely wired diodes. The latter create a slight difference between the voltages applied to the leading and trailing motors in order to maintain the tautness of the scroll. A step-down transformer mounted near or upon the existing light fixture avoids having to carry high voltage anywhere else within the device.

Some of the technology used in the preferred embodiment of the invention are drawn from the parent U.S. Pat. Nos. 5,410,330, 5,493,802 and 5,717,424 which parent patents are incorporated within this specification by this reference.

DESCRIPTION OF THE PREFERRED EMBODIMENT OF THE INVENTION

Figure 1:
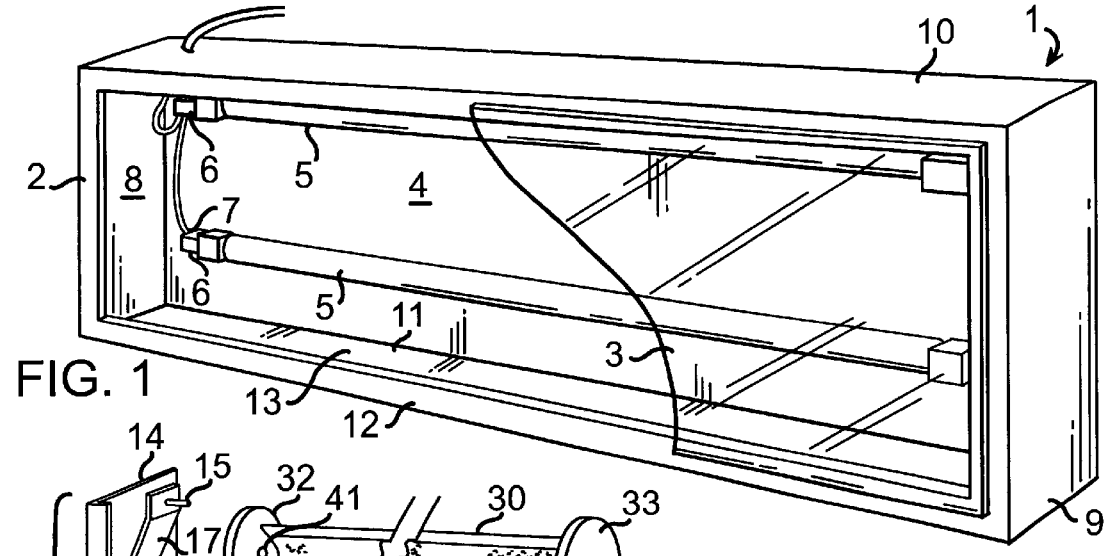
FIG. 1 is a perspective view of a back-lighted display or sign of the prior art.

Referring now to the drawing, there is shown in FIG. 1, a back-lighted sign or display 1 which comprises a hexahedral enclosure 2 and a transparent or semi-transparent panel 3. The enclosure has a back panel 4 mounting one or more light fixture 5. Typically, each light fixture is a fluorescent lamp with a ballast module 6 having terminals 7 for connection to a source of AC electrical power. The enclosure 2 has two parallel and opposite vertical or longitudinal walls 8, 9, and two opposite and parallel horizontal or latitudinal walls 10, 11. The front panel 12 has a window cutout 13 covered by the transparent or semi-transparent panel 3 upon which an image or message is imprinted. In some cases, a stationary or moving translucid banner carrying a design or message may be mounted between the light fixtures and the transparent panel.

Figure 2:
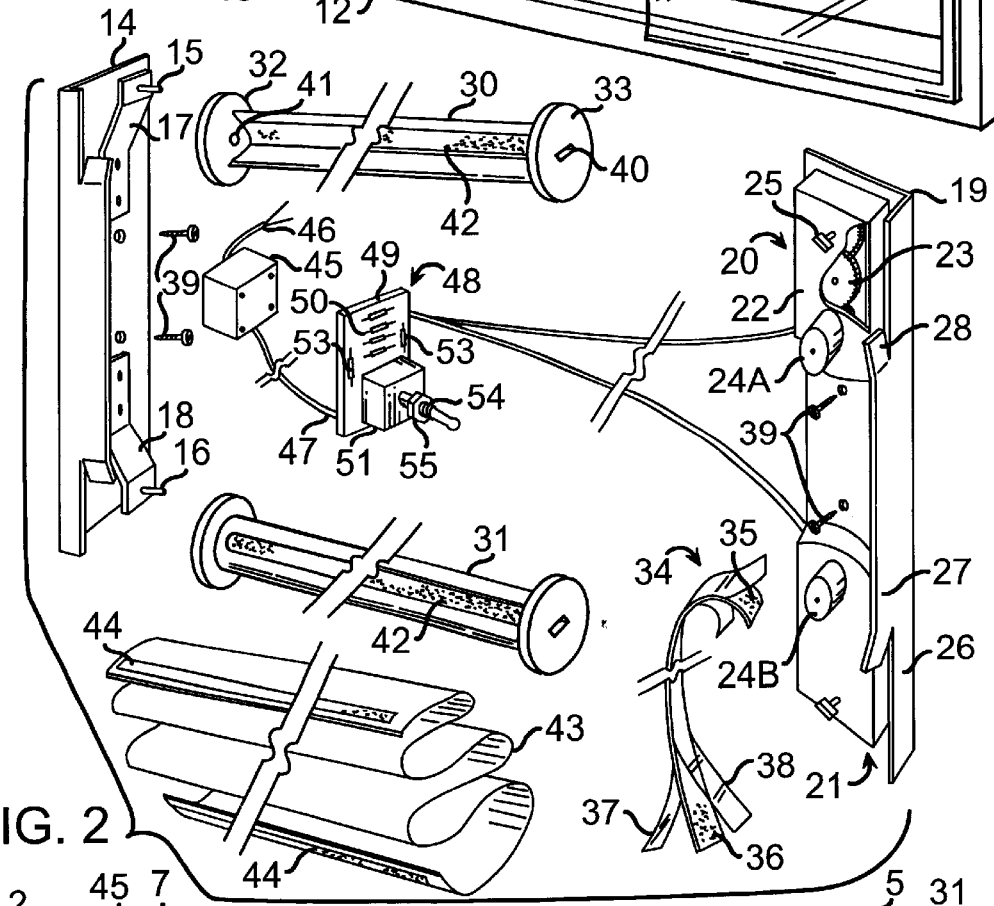
FIG. 2 is a perspective view of the various components used in the preferred embodiment of the invention.

The various components which are necessary and sufficient to implement a scrolling display within the enclosure 2 of FIG. 1 are illustrated in FIG. 2. A first sheet-metal rail or bracket 14 has a height commensurate with the height of one of the vertical walls 8, 9 and is generally shaped and dimensioned to conveniently mount inside the enclosure and against that wall. Near the opposite upper and lower ends of the rail are two pintles 15, 16 held and resiliently based by leaf springs, 17, 18 in an axial direction perpendicular to the rail 14 and inwardly away from it.

A second rail 19 substantially symmetrical with the first rail 14, mounts a pair of drive units 20, 21 near opposite upper and lower ends thereof. Each drive unit comprises a mounting case 22 or module which houses a gear-down assembly 23 interposed between an electrical motor 24A, 24B and a keyed drive spindle 25. Each drive spindle is positioned opposite and in line with one of the pintles 15, 16 of the first rail. Each of the rails 14, 19 has an angular frontal flange 26 having a banner-guiding projection 27 with slightly bent upper and lower ends 28, 29.

A pair of rollers 30, 31 are made from sections of PVC pipe stock capped at either end with disks 32, 33. One disk of each roller has an axial, central bore 40 shaped and dimensioned to engage one of the drive spindles 25. The other disk has an axial central bore 41 shaped and dimensioned to engage one of the pintles 15, 16.

The rails 14, 19 are secured against vertical walls by a section of adhesive tape 34 having layers of adhesive 35, 36 applied to its opposite faces, and protected by peelable films 37, 38. Alternately, the rail can be secured to the walls by means of sheet metal screws 39. Once the rails are secured into the enclosure, the rollers, whose lengths are commensurate with the space between the spindles and pintles can be conveniently and removably installed by pushing against the spring-biased pintles in order to engage the opposite drive spindles.

Bonded to each roller is a strip of hooks-and-vanes fabric fasteners 42. A scroll 43 carrying a plurality of display banners has strips of fabric fasteners 44 commensurate and interconnectable with those mounted on the rollers at opposite ends thereof. Accordingly, the scroll can be secured and wound from opposite ends upon the pair of rollers.

Figure 3:
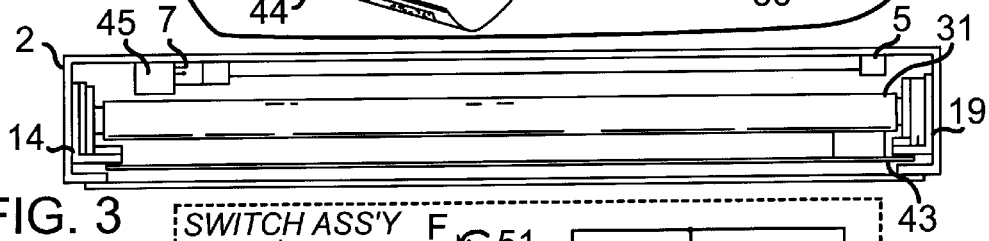
FIG. 3 is a median, horizontal cross-sectional view of a scrolling display.

As shown in FIG. 3, a transformer 45 is mounted next to or upon one of the ballast modules 6 and has its primary pigtail 46 connected to the module terminals 7. It should be understood that in some applications, the connections may be made to a power source outside the enclosure. The secondary, low voltage output of the transformer is brought through a cable 47 to a switch assembly 48. The switch assembly consists essentially of a printed circuit board 49 mounting a bridge rectifier 50, a double-pole, three-position switch 51 and two zener diodes 52, 53. The switch assembly 48 is conveniently mounted against the lower horizontal wall 11 of the enclosure by passing its threaded shaft 54 through a hole in that wall, and securing it thereupon by means of a nut 55.

It should be noted that the entire electrical assembly except for the transformer primary short pigtail 46, is under the low voltage provided by the transformer. This feature is not only desirable from the point of view of safety, but brings the entire kit within government and insurance underwriter specifications.

Figure 4:
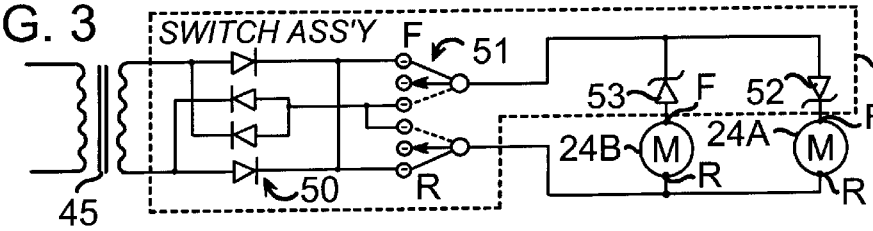
FIG. 4 is an electrical schematic thereof.

Referring now to FIG. 4, when the switch 51 is left in its normal central position 56, no power is applied to the DC motors. When the switch is moved to the F (Forward) position, a forward positive voltage is applied through the zener diodes 52, 53 to the motor's forward terminals F of the motors. The forward biased zener diode 52 associated with the leading motor 24A do not substantially reduce the amount of voltage applied to that motor. By contrast, the backward biased zener diode 53 associated with the trailing motor 25B substantially reduces the amount of voltage applied to that motor. Consequently, the leading motor 24A receives more power than the trailing motor 24B, and tends to run a little faster. This difference between the speeds of the motors places some stress on the scroll helping to keep it taut during the scrolling operation.

When the arm of the switch is moved to the R (Reverse) position, the positive voltage is applied to the R terminals of the motors and their roles are reversed. Higher voltage is applied to the now leading motor 24B, while zener 52 reduces the amount of voltage applied across the now trailing motor 24A.

In the preferred embodiment of the invention, drive units having a rated voltage of 12 VDC that are commercially available from Molon Motor & Coil corporation of Chicago, Ill. are used. The rectified voltage obtained from a 110/12.6 V step-down transformer is limited by approximately 0.7 V of forward voltage drop and 3.1 V backward voltage drop of the respective zener diodes.

While the preferred embodiments of the invention have been described, modifications can be made and other embodiments may be devised without departing from the spirit of the invention and the scope of the appended claims.

What is claimed is:

1. A kit of components for implementing a scrolling banner sign inside a hexahedral display case, said display case including a front panel having a window cut-out and a pair of substantially parallel and opposite longitudinal walls;

said kit consisting essentially of:

first and second rails, said rails being longitudinally substantially commensurate with one of said longitudinal walls, and means for attaching said rails to said longitudinal walls, said first rail mounting a pair of pintles oriented in a direction perpendicular to said longitudinal wall, said pintles being located proximately to opposite ends of said first rail, and being resiliently and axially biased away from said rail;

said second rail mounting a pair of drive units, each in a position opposite and aligned with, one of said pintles;

each of said drive units consisting essentially of a mounting module, a directionally reversable electrical motor having a pair of forward and reverse terminals, and gear-down assembly having a drive spindle;

a pair of rollers, each having a first axial end shaped and dimensioned to engage one of said pintles, and an opposite second axial end shaped and dimensioned to engage one of said drive spindles;

a banner scroll having means at opposite ends for attachment to said rollers;

a transformer; and a switch assembly consisting essentially of a rectifier, a switch, pair of diodes, and a set of conductors wired to apply a step-down voltage from said transformer to said rectifier, and a rectified power from said rectifier to said motors through said diodes in alternately switchable polarities.

2. The kit of claim 1, wherein said means for attaching to said rollers essentially consists of a first strip of hook-and-vane fabric fastener attached to each of said ends, and a second strip commensurate and interconnectable with said first strip attachable to each one of said rollers.

3. The kit of claim 1, wherein said switch consists essentially of two mechanically coupled arms alternately movable to a left position in contact with a positive pole of said rectifier, a central open position, and a right position in contact with a negative pole of said rectifier.

4. The kit of claim 3, wherein said diodes are wired each in an opposite direction to the other between one of said arms and the forward terminals of said motor.

5. The kit of claim 4, wherein said switch assembly further consists of a printed circuit board mounting said switch, rectifier and diodes.

6. The kit of claim 1, wherein said means for securing said rail consists essentially of a strip of paper coated on opposite sides with layers of adhesive, and peelable films covering said adhesive layers.

7. The combination of a hexahedral display case, said case including a front panel mounting having a window cut-out, and a pair of parallel and opposite longitudinal walls with a scrolling banner display assembly, wherein said assembly comprises:

first and second rails having an equal length substantially commensurate with one of said longitudinal walls;

means for attaching said rail to said longitudinal walls in parallel opposite positions;

said first rail mounting a pair of pintles oriented in a direction perpendicular to said longitudinal wall, said pintles being located proximately to opposite ends of said first rail, and being resiliently and axially biased away from said rail;

said second rail mounting a pair of drive units, each in a position opposite and aligned with, one of said pintles;

each of said drive units comprising a mounting module, a directionally reversable electrical motor having a pair of forward and reverse terminals, and a gear-down assembly having a drive spindle;

a pair of rollers, each having a first axial end shaped and dimensioned to engage one of said pintles, and an opposite second axial end shaped and dimensioned to engage one of said drive spindles;

a banner scroll having means at opposite ends for attachment to said rollers;

a transformer; and a switch assembly comprising a rectifier, a switch, pair of diodes, and a set of conductors wired to apply a step-down voltage from said transformer to said rectifier, and a rectified power from said rectifier to said motors through said diodes in alternately switchable polarities.

8. The combination of claim 7, wherein said means for attaching to said rollers comprises a first strip of hook-an-vane fabric fastener attached to each of said ends, and a second strip commensurate and interconnectable with said first strip attachable to each one of said rollers.

9. The combination of claim 7, wherein said switch comprises two mechanically coupled arms alternately movable to a left position in contact with a positive pole of said rectifier, a central open position, and a right position in contact with a negative pole of said rectifier.

10. The combination of claim 9, wherein said diodes are wired each in an opposite direction to the other between one of said arms and the forward terminals of said motor.

11. The combination of claim 10, wherein said switch assemly further comprises a printed circuit board mounting said switch, rectifier and diodes.

12. The combination of claim 7, wherein said means for securing said rail comprises a strip of paper coated on opposite sides with layers of adhesive, and peelable films covering said adhesive layers.

13. A method for implementing a scrolling banner display into a hexahedral sign case, said case including a back panel mounting at least one light fixture having terminals for connection to a source of AC power, a front panel having a window cut-out, a first pair of parallel and opposite longitudinal walls and a second pair of parallel and opposite latitudinal walls;

said method comprising:

manufacturing and attaching to said longitudinal wall, a pair of first and second rails having an equal length substantially commensurate with one of said longitudinal walls;

said first rail mounting a pair of pintles oriented in a direction perpendicular to said longitudinal wall, said pintles being located proximately to opposite ends of said first rail, and being resiliently and axially biased away from said rail;

said second rail mounting a pair of drive units, each in a position opposite and aligned with, one of said pintles;

each of said drive units including a mounting module, a directionally reversable electrical motor having a pair of forward and reverse terminals, and a gear-down assembly having a drive spindle;

mounting between said rail, a pair of rollers, each having a first axial end shaped and dimensioned to engage one of said pintles, and an opposite second axial end shaped and dimensioned to engage one of said drive spindles;

attaching a banner scroll to said rollers;

connecting the primary windings of a step-down transformer to power input terminal of said light fixture;

connecting the secondary winding of said transformer to the input of a rectifier circuit;

connecting the output of said circuit to terminals of a two-pole switch; and the arms of said switch to said motors through two diodes of inverse directions.

14. The method of claim 13, wherein said step of attaching to said rollers comprise using a first strip of hook-and-vane fabric fastener bonded to opposite ends of said scroll, and a second strip commensurate and interconnectable with said first strip attached to each one of said rollers.

15. The method of claim 13, wherein said step of connecting the output of said circuit comprises using a switch having two mechanically coupled arms alternately movable to a left position in contact with a positive pole of said rectifier, a central open position, and a right position in contact with a negative pole of said rectifier.

16. The method of claim 13, wherein said step of attaching said rails comprises placing a strip of paper coated on opposite sides with layers of adhesive between said rails and said longitudinal wall.

17. The method of claim 13, wherein said step of connecting the primary winding comprise installing said transformer proximately to one of said light fixtures.

* * * * *